US006516987B1

(12) United States Patent
Sohl et al.

(10) Patent No.: US 6,516,987 B1
(45) Date of Patent: Feb. 11, 2003

(54) HORIZONTAL STRIP ACCUMULATOR

(75) Inventors: Ralf-Hartmut Sohl, Solingen (DE); Peter de Kock, Oberhausen (DE)

(73) Assignee: SMS Schloemann-Siemag Aktiengesellschaft, Düsselderf (DE)

( * ) Notice: Subject to any disclaimer, the term of this patent is extended or adjusted under 35 U.S.C. 154(b) by 0 days.

(21) Appl. No.: 09/763,119

(22) PCT Filed: Aug. 19, 1999

(86) PCT No.: PCT/EP99/06061

§ 371 (c)(1),
(2), (4) Date: Apr. 23, 2001

(87) PCT Pub. No.: WO00/12238

PCT Pub. Date: Mar. 9, 2000

(30) Foreign Application Priority Data

Aug. 26, 1998 (DE) ..... 198 38 780

(51) Int. Cl.[7] ..... B65H 20/30; B21B 39/20
(52) U.S. Cl. ..... 226/118.2; 72/252; 226/113
(58) Field of Search ..... 226/118.2, 113; 72/252

(56) References Cited

U.S. PATENT DOCUMENTS

| | | | | |
|---|---|---|---|---|
| 3,515,327 A | * | 6/1970 | Bortmas | 226/118.2 |
| 3,687,348 A | * | 8/1972 | Scheib | 226/118.2 |
| 4,367,832 A | * | 1/1983 | Fabian et al. | 226/118.2 |
| 4,391,400 A | * | 7/1983 | Sylvain | 226/118.2 |
| 6,202,912 B1 | * | 3/2001 | Perret et al. | 226/118.2 |

* cited by examiner

*Primary Examiner*—Michael R. Mansen
(74) *Attorney, Agent, or Firm*—Friedrich Kueffner

(57) ABSTRACT

A horizontal strip accumulator for metal strip includes a looper car which is moveable along a travel path at at least one swivel gate which is moveable, when the looper car is moved, by the looper car between a starting position and an end position. For moving the swivel gate, the looper car acts on an actuating element which is connected with the swivel gate through a four-gear mechanism with two swivels. The swivel gate is rotatably arranged on one swivel and the actuating element is rotatably arranged on the other swivel. The actuating element has spoke-shaped projections and the looper car has counter projections which engage between the spoke-shaped projections.

6 Claims, 2 Drawing Sheets

HORIZONTAL STRIP ACCUMULATOR

BACKGROUND OF THE INVENTION

1. Field of the Invention

The present invention relates to a horizontal strip accumulator for metal strip, in particular, steel strip, comprising a looper car, which can be moved along a travel path, and at least one swivel gate, which is moved by the looper car from a starting position to an end position when the looper car is moved, wherein the looper car, when moving the swivel gate, acts on an actuating element which is connected with the swivel gate by means of a four-gear mechanism with two swivels, wherein the swivel gate is rotatably arranged on one and the actuating element is rotatably arranged on the other of the swivels.

2. Description of the Related Art

In horizontal strip accumulators, the stored strip must be supported in order to prevent too much sagging of, the strip. Two systems are known for this purpose. In one system follower cars are used which follow behind the looper car and thus provide strip support with uniform spacing. In the other system, swivel gates are fastened on the sides of the strip accumulator at uniform spacing. The swivel gates are opened for passage of the looper car. The present invention relates to the system with the swivel gates.

Horizontal strip accumulators for metal strip have been used in the past in rolling mills. Here, the actuating element was in the form of a vehicle tire which was entrained by the looper car with frictional connection. The construction of this horizontal strip accumulator was relatively simple. However, as a result of the frictional connection of looper car and actuating element, the adjustment of the actuating element was very critical. Moreover, the actuating element was very wear-prone and also comparatively unreliable as a result of the dependency of the frictional connection on the tire pressure.

SUMMARY OF THE INVENTION

The object of the present invention resides in that a horizontal strip accumulator for metal strip is to be provided which operates considerably more reliably while maintaining the simple constructive configuration.

The object is solved in that the looper car upon movement of the swivel gate engages positive-lockingly the actuating element. By doing so, a forced guiding of the actuating element is effected so that disturbances by a faulty frictional connection can no longer occur. Also, the adjustment of the actuating element relative to the travel path of the looper car is significantly less critical.

When the swivel gate has a holding element, by which the swivel gate is reliably secured in the starting position as well as in the end position, a separate locking mechanism for the swivel gate is obsolete. The holding element can alternatively be embodied, for example, as a spring or as a weight.

When the actuating element has spoke-shaped projections having a projecting thickness and being spaced from one another by a spoke distance and the looper car engages with counter projections the space between the spoke-shaped projections, the constructive configuration of the actuating element of the looper car is especially simple.

When the counter projections are embodied to be roll-like, an especially wear-reduced and friction-reduced contact of the counter projections with the projections is realized. Also, in this case the swivel gate is entrained especially smoothly by the looper car.

When neighboring counter projections are spaced from one another alternatingly by a large and small spacing, an especially minimal play of the actuating element and thus of the swivel gate results when the looper car changes its direction of movement during actuation.

The play of the swivel gate/the actuating element is practically zero when the small spacing corresponds such with the projecting thickness that one of the spoke-shaped projections can be introduced between the neighboring counter projections, which are spaced from one another by the small spacing, and the sum of the large and small spacings is at least approximately identical to the spoke distance.

BRIEF DESCRIPTION OF THE DRAWINGS

Further advantages and details result from the following description of one embodiment. The basic representation shows in.

DETAILED DESCRIPTION OF THE INVENTION

Figure 1:
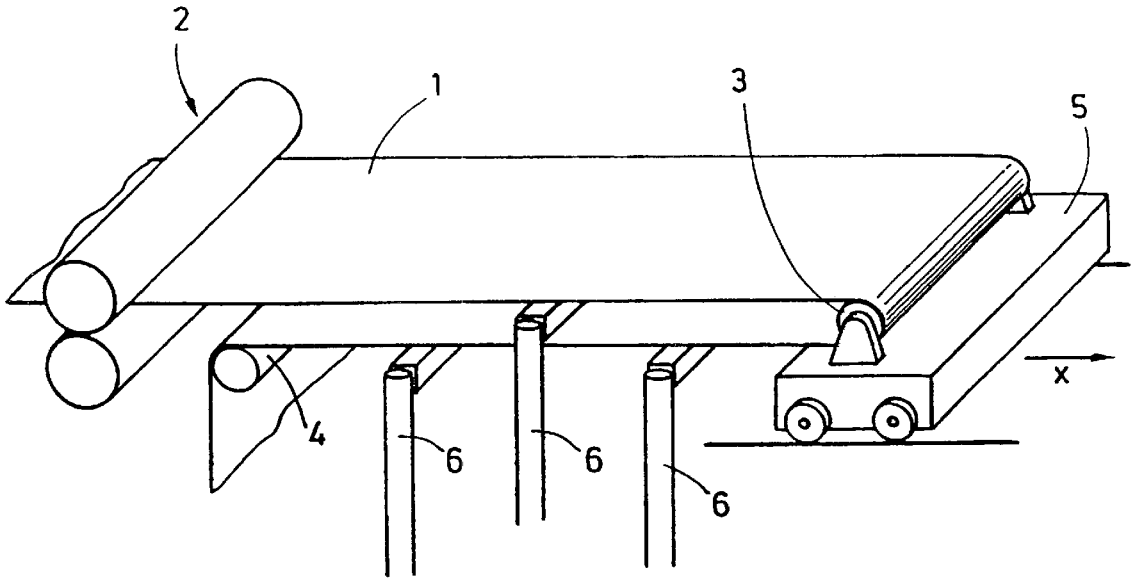
FIG. 1 a horizontal strip accumulator.

According to FIG. 1 a steel strip 1 exits the roll stand 2. The steel strip 1 is guided across a first deflection roll 3 and a second deflection roll 4 after exiting from the roll stand 2. The first deflection roll 3 is arranged on a looper car 5. The looper car 5 can be moved along a travel path in the movement direction x. By moving the looper car 5, the length of the steel strip 1 which is positioned between the roll stand 2 and the second deflection roll 4 will change. The looper car 5 in cooperation with the roll stand 2 and the second deflection roll 4 thus forms a strip accumulator. Since the strip 1 is positioned horizontally in the storage area, the strip accumulator is a horizontal strip accumulator.

The looper car 5 can be spaced up to 100 meters from the roll stand 2 and the second deflection roll 4. In order to prevent an excessive sagging of the steel strip 1, it is therefore required to support the steel strip 1. For this purpose, swivel gates 6 are provided. When the looper car 5 moves toward the roll stand 2, it moves the respective closest swivel gate 6 from a closed into an open position. The closed position corresponds in this case to the starting position, the open positioned to the end position. In reverse order, the looper car 5, after passing one of the swivel gates 6 in the opposite direction, will close this swivel gate. In this case, the open position corresponds to the starting position, the closed position to the end position.

The swivel gates 6 are thus moved by the looper car 5. For this purpose, the looper car 5 acts on an actuating element 7 on each one of the swivel gates 6. The cooperation of looper car 5 and actuating element 7 will be explained in the following in connection with FIG. 2.

Figure 2:
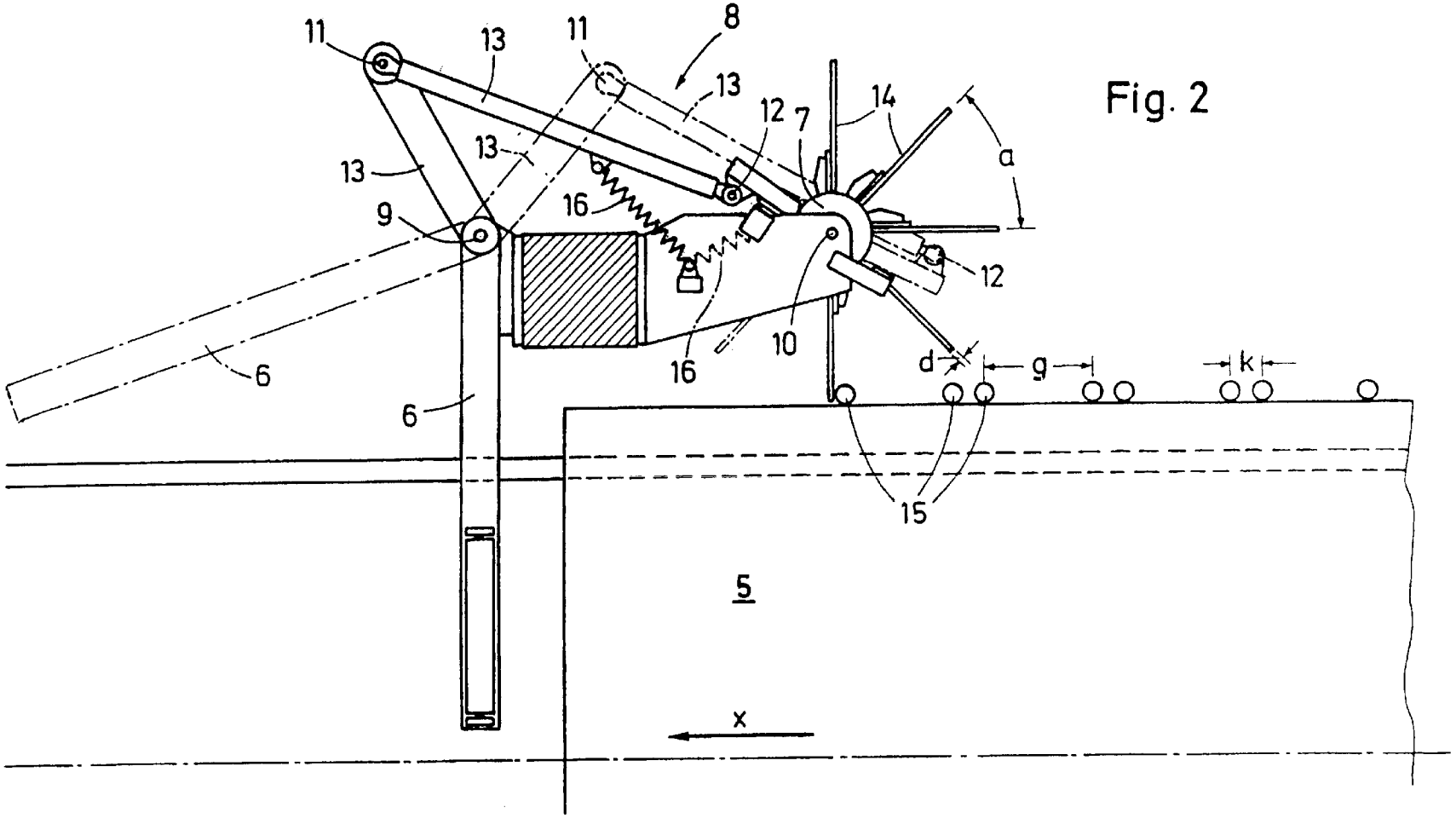
FIG. 2 a looper car and a swivel gate.

According to FIG. 2, the actuating element 7 is connected by a four-gear mechanism 8 with the swivel gates 6, respectively. The four-gear mechanism 8 has two swivels 9, 10 and two hinge points 11, 12. The swivels and the hinge points 9 through 12 are connected to one another by lever arms 13. It is shown that the respective swivel gate 6 is rotatably arranged on one and the actuating element 7 is rotatably arranged on the other one of the swivels 9, 10.

For moving the respective swivel gate 6, the looper car 5 acts on the actuating element 7. The looper car 5 engages in a positive-locking connection the actuating element 7. Accordingly, a forced entrainment of the actuating element 7 results. A frictional connection between actuating element 7 and looper car 5 is not required.

The positive-locking connection according to FIG. 2 is realized in that the actuating element 7 has spoke-shaped projections 14. The spoke-shape projections 14 have a projecting thickness d. They are spaced from one another by a spoke distance a. Counter projections 15 are arranged on the looper car 5 which engage the space between the spoke-shaped projections 14 when the looper car 5 is moved. As can be seen in FIG. 2, the counter projections 15 are embodied in a roll-like fashion and are spaced alternatingly by a large and a small spacing g, k from one another. The small spacing k corresponds to the projecting thickness d such that one of the spoke-shaped projections 14 can be inserted into the space between two counter projections 15, respectively, which are spaced from one another by the small spacing k. The large spacing g is sized such that successively arranged spoke-shaped projections of the actuating element 7 can be introduced into the space between two counter projections 15 which are spaced from one another by the smaller spacing k. The sum of large spacing g and small spacing k is thus, at least approximately, identical to the spoke spacing a.

The swivel gate 6 must be secured in its starting position and its end position against accidental positional changes. This can be achieved, for example, by a separate locking mechanism. According to the embodiment, here FIG. 1, the swivel gate 6 has a holding element 16. The swivel gate 6 is stably secured in the starting position as well as in the end position by the holding element 16. According to the embodiment, the holding element 16 is a spring 16. As an alternative, the holding element 16 could also be embodied as a weight.

List of Reference Numerals 1 steel strip
2 roll stand
3, 4 deflection rolls
5 looper car
6 swivel gates
7 actuating element
8 four-gear mechanism
9, 10 swivels
11 12 hinge points
13 lever arms
14 spoke-shaped projections
15 counter projections
16 holding element/spring
a spoke distance
d projecting thickness
g, k spacings
x movement direction

What is claimed is:

1. A horizontal strip accumulator for metal strip, the accumulator comprising a looper car movable along a travel path, and at least one swivel gate movable, when the looper car is moved, by the looper car between a starting position and an end position, wherein the looper car, for moving the swivel gate, acts on an actuating element, wherein the actuating element is connected to the at least one swivel gate through a four-gear mechanism having two swivels, wherein the at least one swivel gate is rotatably arranged on one of the swivels and the actuating element is rotatably arranged on another of the swivels, wherein the actuating element has spoke-shaped projections, and wherein the looper car has counter projections which engage between the spoke-shaped projections of the actuating element.

2. The horizontal strip accumulator according to claim 1, wherein the at least one swivel gate comprises a holding element for stably securing the at least one swivel gate in the starting position and in the end position.

3. The horizontal strip accumulator according to claim 2, wherein the holding element is a spring.

4. The horizontal strip accumulator according to claim 1, wherein the counter projections are cylindrical.

5. The horizontal strip accumulator according to claim 1, wherein neighboring counter projections are spaced alternatingly by a large and a small spacing from one another.

6. The horizontal strip accumulator according to claim 5, wherein the spoke-shaped projections have a projecting thickness and are spaced from one another by a spoke distance, wherein the small spacing corresponds to the projecting thickness such that one of the spoke-shaped projections can be inserted between neighboring counter projections which are spaced from one another by the small spacing, and wherein a sum of large and small spacings is at least approximately identical to the spoke distance.

* * * * *